US007237560B2

(12) United States Patent
Macias et al.

(10) Patent No.: US 7,237,560 B2
(45) Date of Patent: Jul. 3, 2007

(54) DISPOSABLE COMBINATION TOOTHBRUSH AND DENTAL FLOSS HOLDER

(76) Inventors: Ricardo N. Macias, 513 Winbigler St., Ansonia, OH (US) 45303; Gregory R. Byrd, 4715 St. Rt. 49, Greenville, OH (US) 45331

( * ) Notice: Subject to any disclaimer, the term of this patent is extended or adjusted under 35 U.S.C. 154(b) by 187 days.

(21) Appl. No.: 10/861,985

(22) Filed: Jun. 4, 2004

(65) Prior Publication Data

US 2005/0268934 A1 Dec. 8, 2005

(51) Int. Cl.
*A45D 44/18* (2006.01)

(52) U.S. Cl. ..... 132/309

(58) Field of Classification Search ..... 132/309, 132/311

See application file for complete search history.

(56) References Cited

U.S. PATENT DOCUMENTS

| | | | | | |
|---|---|---|---|---|---|
| 1,279,507 | A | * | 9/1918 | Briggs | 132/321 |
| 1,312,896 | A | * | 8/1919 | Donnelly | 132/309 |
| 1,646,082 | A | * | 10/1927 | Dailey | 132/309 |
| 1,773,041 | A | | 8/1930 | Healy | |
| 2,233,522 | A | * | 3/1941 | Fickle | 132/309 |
| 2,601,244 | A | | 6/1952 | Boulicault | |
| 3,782,397 | A | * | 1/1974 | McCord | 132/309 |
| 3,853,134 | A | | 12/1974 | McCord | |
| 3,890,986 | A | | 6/1975 | Gerlich et al. | |
| 4,294,269 | A | * | 10/1981 | Kyte | 132/309 |
| 4,887,621 | A | | 12/1989 | Vallieres | |
| 4,919,155 | A | * | 4/1990 | Yasuda | 132/278 |
| 5,097,852 | A | | 3/1992 | Wu | |
| 5,490,530 | A | | 2/1996 | Snowden | |
| 5,676,167 | A | * | 10/1997 | Garner | 132/309 |
| 5,769,553 | A | * | 6/1998 | Chaudhri et al. | 401/195 |
| 5,924,429 | A | | 7/1999 | Morando | |
| 5,950,641 | A | | 9/1999 | Taveras | |
| 6,672,783 | B1 | | 1/2004 | Licata et al. | |
| 2003/0188761 | A1 | | 10/2003 | Garcia | |

* cited by examiner

*Primary Examiner*—Todd E. Manahan
(74) *Attorney, Agent, or Firm*—Dinsmore & Shohl LLP

(57) ABSTRACT

A disposable combination toothbrush and dental floss dispenser is provided. The toothbrush includes a hollow cavity at one end for receiving a dental floss dispenser therein which includes a supply of dental floss. The toothbrush includes a removable end cap which covers and protects the dental floss dispenser when it is not in use. After the supply of dental floss is depleted, the toothbrush may be disposed of.

7 Claims, 3 Drawing Sheets

DISPOSABLE COMBINATION TOOTHBRUSH AND DENTAL FLOSS HOLDER

BACKGROUND OF THE INVENTION

The present invention relates to a disposable toothbrush including a dental floss holder, and more particularly, to a combination disposable toothbrush and dental floss holder which includes a supply of dental floss therein.

Disposable toothbrushes are well known in the art for use by consumers during travel or other events. Such toothbrushes are provided in many different designs and sizes for convenience.

In recent years, the benefits of using dental floss have been widely recognized and it is therefore desirable when traveling to use dental floss in addition to a toothbrush; however, it is cumbersome and inconvenient to pack both a toothbrush and a separate supply of dental floss.

Toothbrushes have been developed which include a dental floss holder within the body of the toothbrush. For example, U.S. Pat. No. 5,924,429 teaches a toothbrush comprising a detachable toothbrush and including a supply of dental floss disposed within the interior cavity of the toothbrush handle. U.S. Pat. No. 4,887,621 teaches a combination toothbrush and dental floss holder where the toothbrush includes a hollow handle including a cavity for storing a spool of dental floss.

However, there is still a need in the art for an improved combination toothbrush and dental floss holder which is easy to make and use and which is disposable for travel use.

SUMMARY OF THE INVENTION

The present invention meets that need by providing a combination toothbrush and dental floss dispenser which is disposable. The toothbrush includes a handle having a hollow cavity at one end for receiving a dental floss dispenser containing a supply of dental floss.

According to one aspect of the present invention, a combination disposable toothbrush and dental floss dispenser is provided comprising a unitary handle having first and second ends where the second end has a hollow interior cavity therein; and plurality of bristles mounted in the first end of the handle. A dental floss dispenser is mounted in the interior cavity of the second end of the handle and contains a supply of dental floss therein. A removable end cap is attached to the second end of the handle. The end cap preferably covers the dental floss dispenser and functions to protect it when not in use.

The dental floss dispenser preferably comprises first and second ends and includes a hollow interior cavity containing the supply of dental floss. The supply of dental floss is preferably in the form of a spool. Preferably, the first end of the dental floss dispenser includes an aperture therein for withdrawing a length of dental floss from the spool.

The dental floss dispenser preferably further includes an outer sidewall having a base mounted thereto which includes a blade extending therefrom for cutting the dental floss to a desired length.

In use, a user may floss by removal of the protective end cap and extraction of dental floss from the dental floss dispenser, followed by brushing their teeth using the toothbrush portion of the handle. The combination toothbrush and dental floss dispenser may be used repeatedly for a time period of about 90 days, after which it may be easily disposed of. As many dentists recommend changing toothbrushes every three months, by use of a 90-day supply of dental floss in the dental floss dispenser, an indication is given as to when to dispose of the toothbrush and start using a new one (i.e., when the dental floss runs out).

Accordingly, it is a feature of the invention to provide a disposable toothbrush and dental floss dispenser combination which may be easily used and disposed of after use. Other features and advantages of the invention will be apparent from the following description, the accompanying drawings, and the appended claims.

DETAILED DESCRIPTION OF THE PREFERRED EMBODIMENTS

Figure 1:
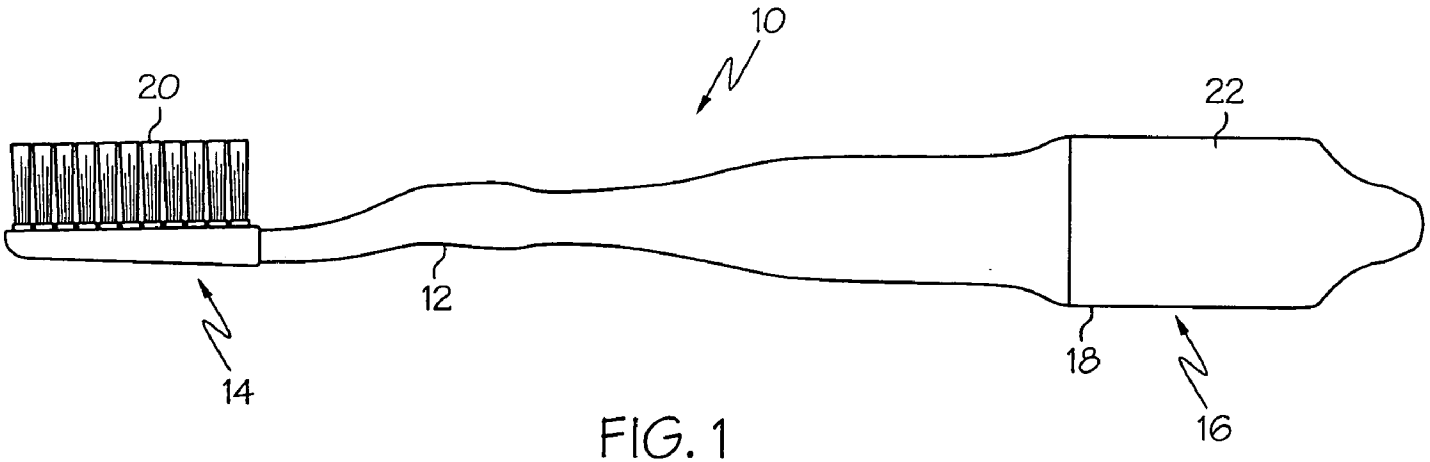
FIG. 1 is an elevational view of the combination disposable toothbrush and dental floss dispenser of the present invention.
Figure 2:
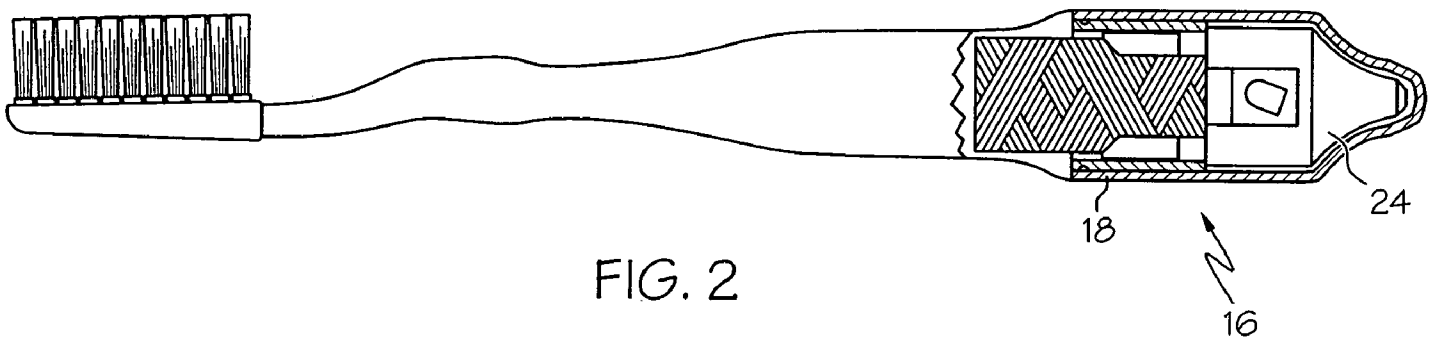
FIG. 2 is a sectional view of the combination of FIG. 1.
Figure 3:
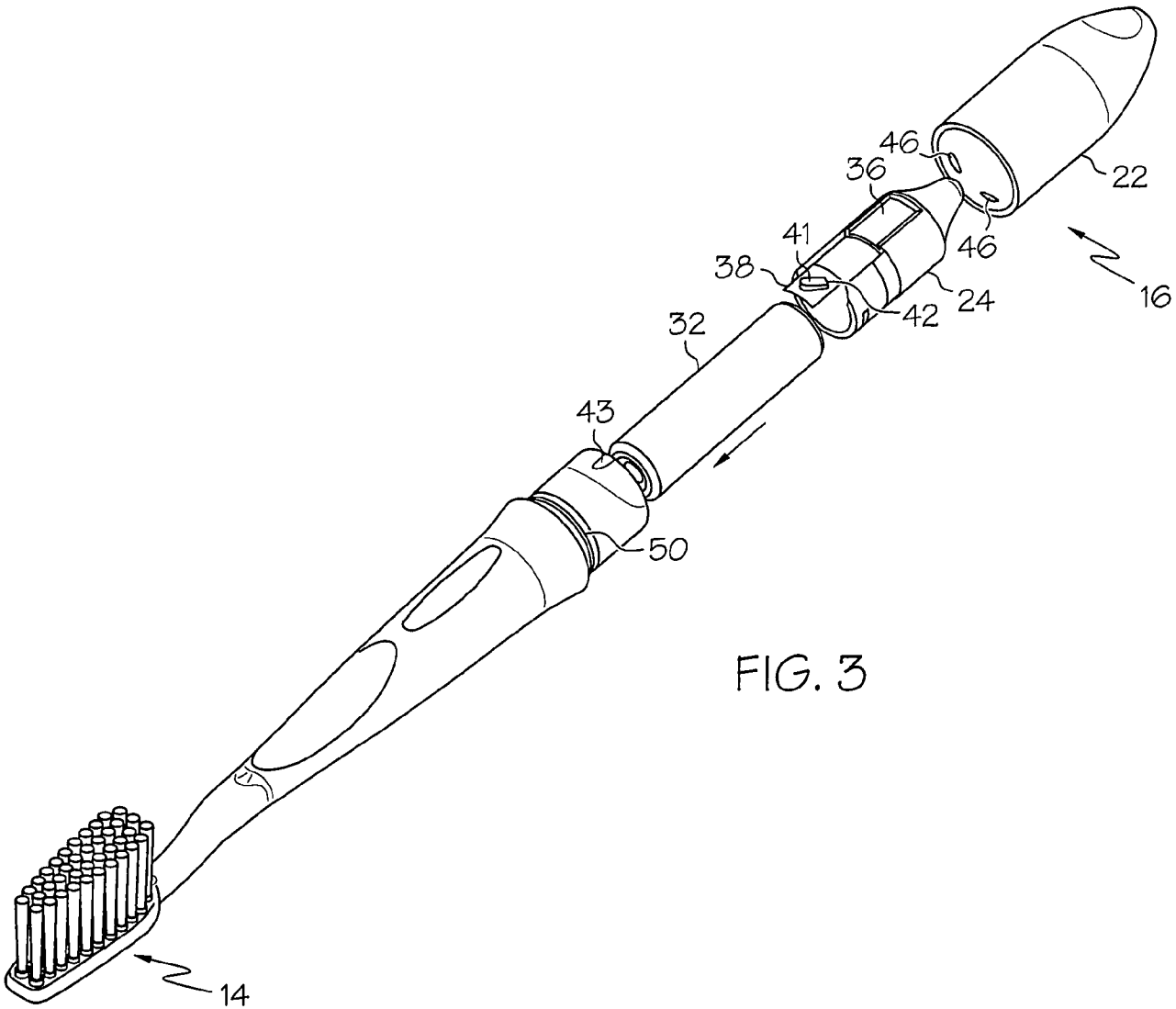
FIG. 3 is an elevational view illustrating the separate elements of the toothbrush/dispenser combination.

Referring now to the drawing figures, the combination toothbrush and dental floss dispenser is illustrated in FIGS. 1–3. As shown in FIG. 1, the combination 10 includes a handle 12 comprising first and second ends 14 and 16 and including a hollow interior cavity 18 at the second end 16. The handle is preferably comprised of a molded polypropylene and is ergonomically friendly, i.e., it is designed to enable a user to easily grip and hold the toothbrush during use.

A plurality of toothbrush bristles 20 are mounted in the first end 14 of the handle. The bristles may be anti-bacterial bristles, such as anti-bacterial bristles available from Team Technologies, Inc. of Morristown, Tenn. However, conventional toothbrush bristles or filaments may also be used. A removable end cap 22 is attached to the second end 16 of the handle in a tight fit so as to be water resistant, allowing for rinsing of the toothbrush without water getting into the floss dispenser 24.

Figure 4A:
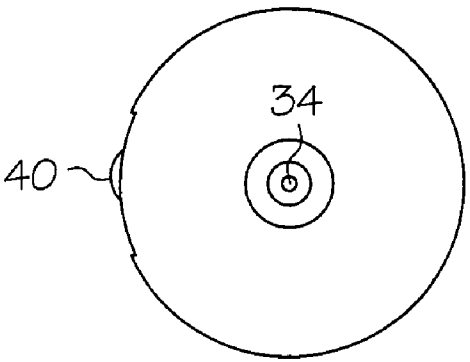
FIG. 4A is a top view of the dental floss dispenser.

A cross-sectional view of the combination toothbrush and dental floss dispenser is illustrated in FIG. 2 and illustrates the dental floss dispenser 24 which is mounted in the interior cavity 18 of the second end 16 of the handle. As shown in greater detail in FIGS. 4 and 4A, the dental floss dispenser 24 includes first and second ends 26 and 28 and a hollow interior cavity 30 containing a supply of dental floss, preferably in the form of a spool 32. The dental floss preferably comprises a cocoon of waxed floss which is preferably about 50 yards in length so as to provide approximately 90 days of usage. A number of conventional types of dental floss may be used in the dental floss dispenser. One suitable dental floss for use includes floss available from Ora-Tek (Canada).

Figure 4:
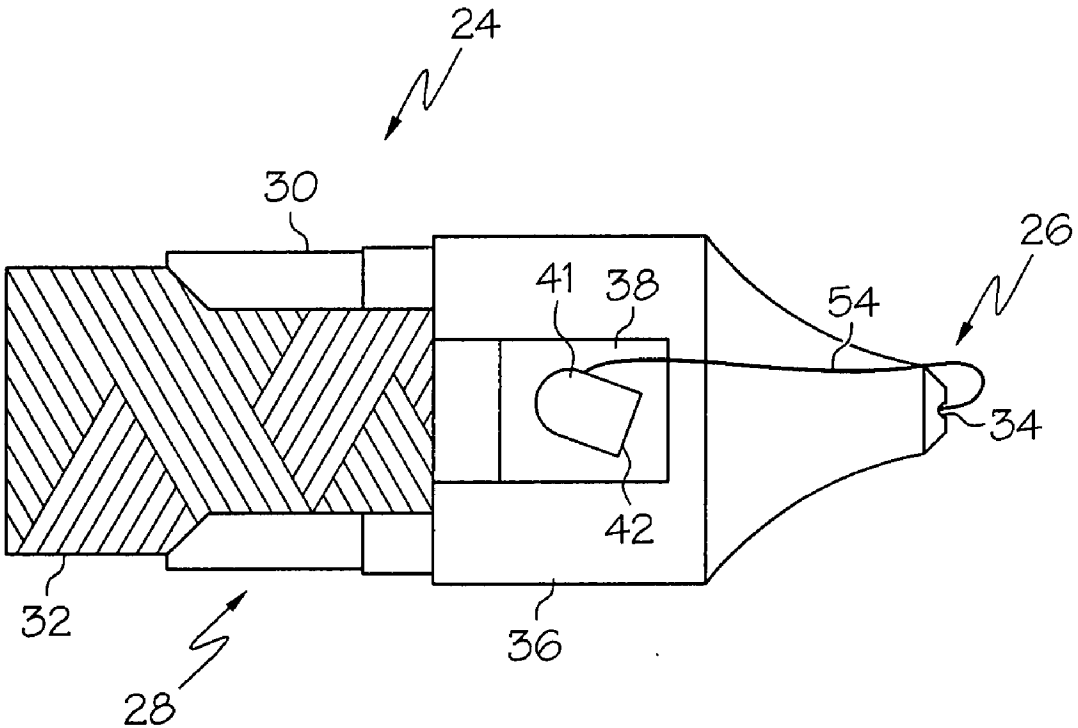
FIG. 4 is an enlarged elevational view of the dental floss dispenser.

As shown in FIG. 4, the first end of 26 of the dental floss dispenser includes an aperture 34 therein for withdrawing a length of dental floss 54 from the spool 32. The dental floss dispenser further includes an outer sidewall 36 and a base 38 mounted on the sidewall which includes a blade 41 and a living hinge 42 extending therefrom for cutting the dental floss 54 to a desired length for use. As shown, the first end 26 of the dental floss dispenser has a concave shape which aids in engaging the floss 54 with the blade 41. As shown in the exploded view illustrated in FIG. 3, the blade 41 is preferably held in place by living hinge 42 which is positioned in a recessed area 36 in the sidewall of the dispenser.

The toothbrush is assembled as shown in FIGS. 2 and 3, with the spool 32 inserted partially into the hollow handle at the recessed area 43 at the end of the handle and partially into dental floss dispenser 24 such that the ends of the toothbrush and dental floss dispenser snap lock together. As shown in FIGS. 2 and 4, the second end 28 of the dental floss dispenser 24 is open such that the spool 32 extends into the hollow interior cavity 18 of the handle.

In use, the toothbrush portion of the handle is used to brush teeth. When it is desirable to floss the teeth, the end cap 22 may be removed from the remainder of the handle as shown in FIG. 3 and a length of floss is withdrawn from the dental floss dispenser 24 through aperture 34 and cut to a desired length using blade 40. As shown in FIG. 4, outer sidewall 36 of the floss dispenser is shaped so that when floss is draped between aperture 34 and blade 41, there is an easy gripping surface providing for grabbing and pulling on the floss. When the user is done, the cap may be replaced on the handle. After the supply of dental floss is depleted, the toothbrush may then be easily disposed of.

It will be apparent to those skilled in the art that various changes may be made without departing from the scope of the invention which is not considered limited to what is described in the specification.

What is claimed is:

1. In combination, a disposable toothbrush and dental floss dispenser comprising:

a handle having first and second ends; said second end having a hollow interior cavity therein;

a plurality of toothbrush bristles mounted in said first end of said handle;

a dental floss dispenser having first and second ends with said second end being inserted in the interior cavity of said second end of said handle and containing a supply of dental floss therein; wherein said second end of said dental floss dispenser is open such that said supply of dental floss is partially positioned in the hollow interior cavity of said second end of said handle and partially in said dental floss dispenser; said dental floss dispenser including an outer sidewall having a base mounted thereto; said base including a blade extending therefrom for cutting said dental floss; and an end cap attached to said second end of said handle which covers said dental floss dispenser when said dental floss dispenser is not in use.

2. The combination of claim 1 wherein said supply of dental floss is in the form of a spool.

3. The combination of claim 1 wherein said first end of said dental floss dispenser includes an aperture therein for withdrawing a length of dental floss from said spool.

4. The combination of claim 1 wherein said first end of said dental floss dispenser has a concave shape.

5. The combination of claim 1 wherein said dental floss dispenser is snap fitted into said second end of said handle.

6. The combination of claim 1 wherein said end cap is snap fitted onto said second end of said handle.

7. The combination of claim 1 wherein said end cap attached to said second end of said handle covers said dental floss dispenser when said toothbrush is not in use.

* * * * *